US010989442B2

(12) United States Patent
Kuriyama et al.

(10) Patent No.: US 10,989,442 B2
(45) Date of Patent: Apr. 27, 2021

(54) HEATING AND HOT WATER SUPPLY DEVICE

(71) Applicant: NORITZ CORPORATION, Hyogo (JP)

(72) Inventors: Yasutaka Kuriyama, Hyogo (JP); Yasushi Morita, Hyogo (JP); Hiroshi Morimoto, Hyogo (JP); Midori Yokoyama, Hyogo (JP); Yoshihisa Kitano, Hyogo (JP); Haruhiko Tamada, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 142 days.

(21) Appl. No.: 16/318,370

(22) PCT Filed: May 24, 2017

(86) PCT No.: PCT/JP2017/019340
§ 371 (c)(1),
(2) Date: Jan. 17, 2019

(87) PCT Pub. No.: WO2018/020804
PCT Pub. Date: Feb. 1, 2018

(65) Prior Publication Data

US 2019/0154304 A1 May 23, 2019

(30) Foreign Application Priority Data

Jul. 26, 2016 (JP) ..... JP2016-146594

(51) Int. Cl.
*F24D 3/02* (2006.01)
*F24H 9/20* (2006.01)
(Continued)

(52) U.S. Cl.
CPC ..... *F24H 9/2035* (2013.01); *F24D 3/08* (2013.01); *F24D 19/1021* (2013.01);
(Continued)

(58) Field of Classification Search
CPC ... F24C 13/00; F24D 3/02; F24D 3/04; F22D 7/00; F24H 9/1809
See application file for complete search history.

(56) References Cited

U.S. PATENT DOCUMENTS 4,522,253 A * 6/1985 Levin ..... F24D 11/0214 165/207
5,701,387 A * 12/1997 McGugan ..... F24D 17/0073 122/13.3
(Continued)

FOREIGN PATENT DOCUMENTS

JP 2586748 3/1997
JP 2002048391 2/2002
(Continued)

OTHER PUBLICATIONS

"International Search Report (Form PCT/ISA/210) of PCT/JP2017/019340," dated Aug. 1, 2017, with English translation thereof, pp. 1-4.

*Primary Examiner* — Gregory A Wilson
(74) *Attorney, Agent, or Firm* — JCIPRNET

(57) ABSTRACT

In a heating and hot water supply device including a burning means, a first heat exchanger, a circulation passage for circulating a heating thermal medium, a circulation pump, a first bypass passage, a second heat exchanger for hot water supply, a hot water supply passage, a distribution means at a branching portion of the first bypass passage, and a second bypass passage bypassing the second heat exchanger, a flow rate adjustment means for adjusting a bypass flow rate in the second bypass passage is provided. The distribution means is capable of adjusting its distribution ratio for heating, or
(Continued)

hot water supply, or simultaneous heating/hot water supply. All passage connection portions on the second heat exchanger were provided on its one side portion.

4 Claims, 5 Drawing Sheets

(51) Int. Cl.
*F24D 3/08* (2006.01)
*F24D 19/10* (2006.01)
*F24H 1/52* (2006.01)

(52) U.S. Cl.
CPC ..... *F24D 19/1069* (2013.01); *F24H 1/52* (2013.01); *F24D 19/1015* (2013.01); *F24D 2220/042* (2013.01)

(56) References Cited

U.S. PATENT DOCUMENTS 7,058,457 B2 * 6/2006 Kuwahara ..... G05B 15/02 700/11
9,010,281 B2 * 4/2015 Fushiki ..... F24H 4/04 122/448.1
9,021,993 B2 * 5/2015 Furukawa ..... F28F 19/00 122/14.3
9,250,105 B2 * 2/2016 Patel ..... G01F 15/0755
9,886,043 B2 * 2/2018 Yuge ..... G05D 23/1919
10,330,328 B2 * 6/2019 Land, III ..... F24D 19/10
10,337,763 B2 * 7/2019 Okamoto ..... F24H 9/2042
2010/0117843 A1 * 5/2010 Kobayashi ..... F24D 17/02 340/622
2012/0305105 A1 12/2012 Min
2015/0034190 A1 * 2/2015 Jebran ..... E03B 7/04 137/565.11
2015/0034730 A1 * 2/2015 Minamisako ..... F24D 19/1024 237/2 B
2016/0033171 A1 * 2/2016 Mase ..... F24H 1/145 122/14.3
2016/0047558 A1 * 2/2016 Shimada ..... F24D 19/1069 237/8 A
2017/0363301 A1 * 12/2017 Son ..... F24D 17/0005

FOREIGN PATENT DOCUMENTS

JP 2005337632 12/2005
JP 2007078324 3/2007
JP 2008082633 A * 4/2008
JP 2009257661 11/2009
JP 2014016112 1/2014

* cited by examiner

HEATING AND HOT WATER SUPPLY DEVICE

CROSS-REFERENCE TO RELATED APPLICATION

This application is a 371 application of the International PCT application serial no. PCT/JP2017/019340, filed on May 24, 2017, which claims priority benefits of Japan Patent Application No. 2016-146594 filed on Jul. 26, 2016. The entirety of each of the above-mentioned patent applications is hereby incorporated by reference herein and made a part of this specification.

TECHNICAL FIELD

The present invention relates to a heating and hot water supply device that performs heating operation by applying heat produced by combustion to a heating thermal medium, and that also performs supply of hot water by applying heat to cold water by heat exchange with the heating thermal medium; and in particular relates to a heating and hot water supply device that is capable of simultaneously performing heating operation and hot water supply operation.

BACKGROUND ART

From the past, heating and hot water supply devices that perform changeover between heating operation (i.e. room heating operation etc.) and hot water supply operation have been widely utilized. With this type of heating and hot water supply device, during hot water supply operation, fuel is combusted and evolves heat that is applied to a heating thermal medium by a main heat exchanger, and the heating thermal medium is circulated between the main heat exchanger and a heat exchanger for hot water supply. A fin and tube type main heat exchanger is employed in the heat exchanger for recovering sensible heat from the combustion gases, and moreover there are some such devices that are also capable of providing heat to the heating thermal medium by also taking advantage of latent heat in the combustion gases.

For the heat exchanger for hot water supply, generally a plate type heat exchanger is employed in which fluid passages are defined between a plurality of plates that are overlapped in the front/rear direction. As illustrated in FIG. 5, in such a heat exchanger for hot water supply 120, a pair of connection portions 129, 130 of a circulation passage through which the heating thermal medium flows are provided at a front surface portion and at a rear surface portion, and a pair of connection portions 131, 132 of a hot water supply passage are likewise provided at a front surface portion and at a rear surface portion. In the heat exchanger for hot water supply 120, cold water flowing in the hot water supply passage exchanges heat with the heating thermal medium, and this heated water is supplied as hot water.

On the other hand, in heating operation, as shown in Patent Document #1, the circulation passage for the heating thermal medium is changed over by a three-way valve so that the heating thermal medium circulates between a heating apparatus and the main heat exchanger. After the heating thermal medium heated by the main heat exchanger has dissipated heat via the heating apparatus, it is returned back to the main heat exchanger again.

However, since changing over between the alternatives of space heating operation and hot water supply operation is performed by changing over the three-way valve, accordingly there is the problem that it is not possible to perform heating operation and hot water supply operation simultaneously. By contrast, it has also been considered to provide, instead of a three-way valve, a distribution valve whose distribution ratio can be adjusted.

Moreover, since control of the hot water supply temperature is performed by controlling the temperature of the heating thermal medium, accordingly it is not easy to control properly the hot water supply temperature. Therefore, as shown in Patent Document #2, it has been considered to provide a bypass passage in the hot water supply passage that bypasses the heat exchanger for hot water supply, and to adjust the flow rate of cold water flowing in the bypass passage and to mix in cold water to the hot water heated by the heat exchanger for hot water supply, thus controlling the hot water supply temperature.

PRIOR ART DOCUMENT

Patent Document

Patent Document #1: US Appln. Publication No. 2012/0305105.

Patent Document #2: Japanese Patent No. 2,586,748.

SUMMARY OF INVENTION

Technical Problem

However, since generally a distribution valve is large in size as compared to a three-way valve, and since typically a heating and hot water supply device is built so as to occupy the minimum limit of space necessary for the tasks of assembling and servicing the device, accordingly it is difficult to ensure sufficient space for providing such a distribution valve, and replacement thereof is difficult. Moreover, if the three-way valve is replaced with a distribution valve, then the provision of installation space for the distribution valve increases the size of the heating and hot water supply device, and this is undesirable because it entails increase of the manufacturing cost.

In a similar manner, it is also difficult to ensure sufficient space for installation of a bypass passage and a means for adjusting the bypass flow rate for appropriate hot water supply temperature control. The provision of installation space for the bypass passage and such a flow rate adjustment means also increases the size of the heating and hot water supply device, and this is likewise undesirable because it entails increase of the manufacturing cost.

The object of the present invention is to provide a heating and hot water supply device that incorporates a heat exchanger for hot water supply which is capable of ensuring proper installation space for a distribution valve, a bypass passage and a bypass flow rate adjustment means without increasing the size of the heating and hot water supply device, and that is capable of simultaneously performing space heating and hot water supply operation, and of controlling the hot water supply temperature in an appropriate manner.

Means to Solve the Problem

The present invention presents a heating and hot water supply device including; a combustion means, a main heat exchanger, a circulation passage connected to the main heat exchanger and a heating apparatus, a circulation pump provided in the circulation passage, a first bypass passage that branches off from the circulation passage and bypasses the heating apparatus, a heat exchanger for hot water supply provided in the first bypass passage, and a hot water supply passage for supplying cold water to the heat exchanger for hot water supply, and for supplying hot water heated by the heat exchanger for hot water supply, wherein: a distribution means is provided at a branching portion of the first bypass passage, and the distribution means is capable of adjusting a distribution ratio so that heating operation, or hot water supply operation, or simultaneous heating operation and hot water supply operation become possible; a second bypass passage that bypasses the heat exchanger for hot water supply is provided in the hot water supply passage, and a flow rate adjustment means is provided that is capable of adjusting a bypass flow rate flowing in the second bypass passage; and the heat exchanger for hot water supply is constituted with a plate type heat exchanger, with a pair of connection portions of the first bypass passage and a pair of connection portions of the hot water supply passage being disposed on one side portion thereof.

According to the constitution described above, since the heat exchanger for hot water supply is a plate type heat exchanger, and the pair of connection portions of the first bypass passage and the pair of connection portions of the water of hot water supply passage are disposed on the one side portion thereof, accordingly it is possible to make the heat exchanger for hot water supply more compact. Furthermore, the heat exchanger for hot water supply is disposed so that the space at one side portion thereof is increased, and accordingly it is possible to ensure sufficient space for installation of the distribution means, the second bypass passage and its flow rate adjustment means. And, since the distribution valve that is capable of adjusting the distribution ratio can be provided in the installation space, accordingly it is possible to perform, not only heating operation or hot water supply operation, but also simultaneous heating operation and hot water supply operation. Yet further, since the second bypass passage and its flow rate adjustment means can be provided in the installation space, accordingly it is possible to control properly the hot water temperature by mixing together the cold water whose flow rate has been adjusted and the heated water heated by the heat exchanger for hot water supply. Therefore, by ensuring sufficient space for installation of the distribution valve, the second bypass passage and its flow rate adjustment means, it is possible to implement appropriate hot water supply temperature control during simultaneous heating and hot water supply operation, without increasing the size of the heating and hot water supply device.

The heat exchanger for hot water supply may be connected so that the heating thermal medium and the supply water for hot water flow in opposite directions.

According to the constitution described above, the heat exchange efficiency of the heat exchanger for hot water supply is enhanced.

The heat exchanger for hot water supply may be disposed above a bottom plate of a casing of the heating and hot water supply device so as to be separated therefrom, with a portion of the second bypass passage being disposed between the heat exchanger for hot water supply and the bottom plate.

According to the constitution described above, since a part of the second bypass passage is disposed below the heat exchanger for hot water supply, accordingly it becomes difficult for heat to be inadvertently applied to the cold water in the second bypass passage, so that the advantageous effect is obtained of preventing hot water from being outputted at excessively hot temperature.

Advantages of Invention

According to the present invention, by providing the heat exchanger for hot water supply with the connection portions disposed on one side portion thereof, the installation space for the heat exchanger for hot water supply becomes compact, so that proper installation space for the distribution valve, the bypass passage and the bypass flow rate adjustment means can be ensured without increasing the size of the heating and hot water supply device, and it is possible to provide a heating and hot water supply device that is capable of simultaneously performing heating operation and hot water supply operation, and that also is capable of controlling the hot water supply temperature in an appropriate manner.

DESCRIPTION OF EMBODIMENTS

In the following, implementations of the present invention will be explained on the basis of embodiments. In the figures, the arrow U indicates "upward", the arrow F indicates "forward", and the arrow L indicates "leftward".

First Embodiment

Figure 1:
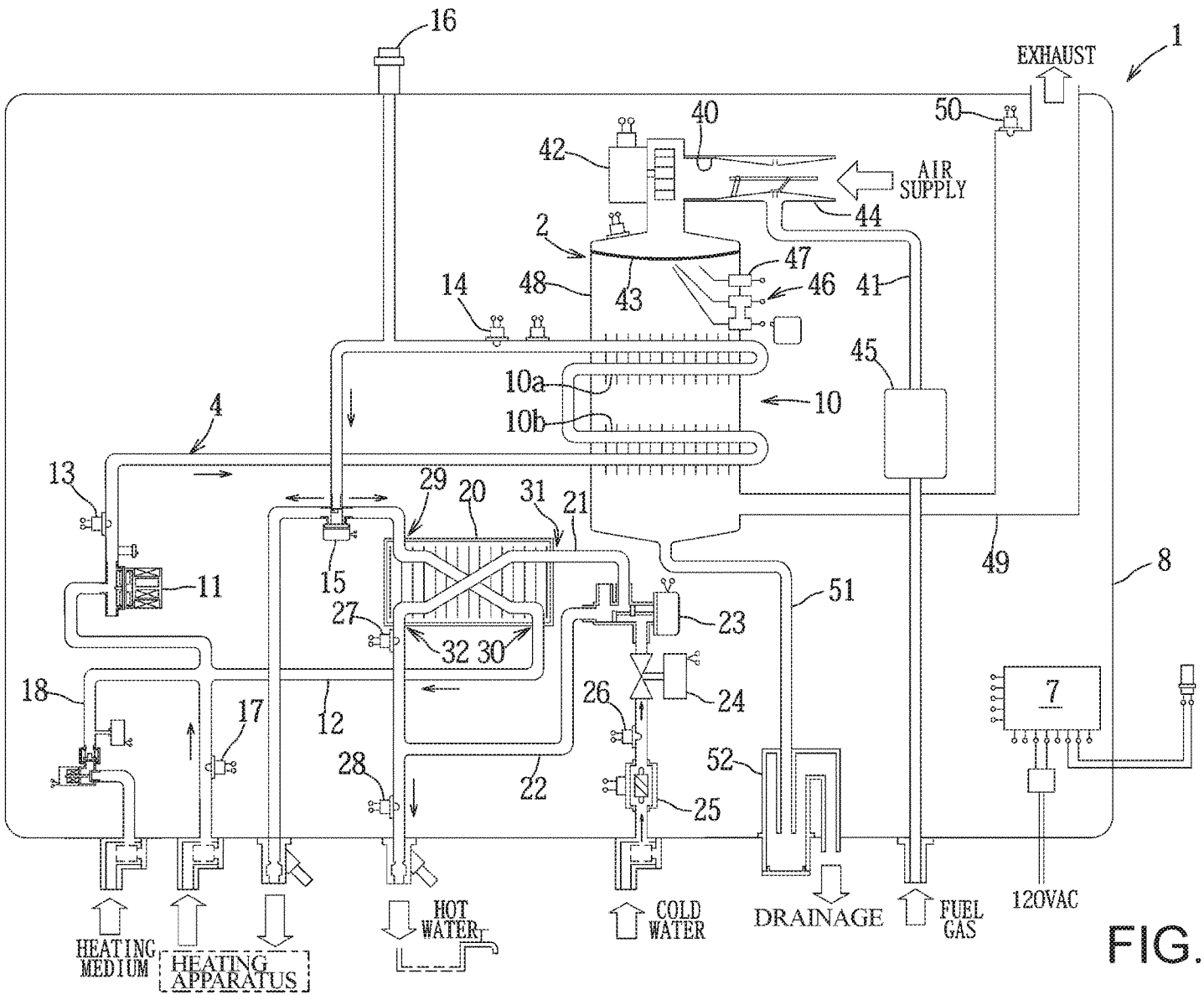
FIG. 1 is a figure schematically showing a heating and hot water supply device according to the present invention.

First, the overall constitution of a heating and hot water supply device 1 of the present invention will be explained with reference to FIG. 1.

The heating and hot water supply device 1 performs space heating operation (i.e. room heating operation etc.) by circulating a heating thermal medium, to which heat has been applied by heat exchange with combustion gases generated by a combustion unit 2, to a space heating apparatus not shown in the figures, and also performs hot water supply operation by supplying cold water to which heat has been applied by heat exchange with the heating thermal medium, while adjusting its temperature to a set hot water supply temperature.

The heating and hot water supply device 1 comprises a combustion unit 2 (a combustion means) that mixes fuel gas and air together and combusts them, a main heat exchanger 10 that applies heat to the heating thermal medium by heat exchange with the combustion gases, a circulation passage 4 that connects the main heat exchanger 10 with the space heating terminal, a circulation pump 11 that circulates the heating thermal medium through the circulation passage 4, and so on.

Moreover, the heating and hot water supply device 1 further comprises a first bypass passage 12 that branches off from the circulation passage 4 and bypasses the heating apparatus, a heat exchanger for hot water supply 20 that is provided in the first bypass passage 12, a hot water supply passage 21 for supplying cold water to the heat exchanger for hot water supply 20 and for supplying hot water to which heat has been applied by the heat exchanger for hot water supply 20. And a first distribution valve 15 (a distribution means), is provided at the branching portion where the first bypass passage 12 branches off from the circulation passage 4.

Furthermore, the heating and hot water supply device 1 comprises a control unit 7 that receives detection signals from temperature sensors and so on and controls heating operation and hot water supply operation by operating the various devices described above, and also comprises a box shaped casing 8 that receives the devices described above. The circulation passage 4 and the hot water supply passage 21 pass out through the casing 8 and are connected to the space heating terminal and an external hot water supply faucet and so on.

Next, the combustion unit 2 will be explained.

The combustion unit 2 comprises an intake passage 40 that takes in air for combustion, a fuel gas passage 41 that supplies fuel gas provided from the exterior into the intake passage 40, a combustion fan 42 that blows the resulting mixture of air and fuel gas through the intake passage 40, and a burner 43 that combusts the mixture gas that has been blown in by the combustion fan 42.

The flow rate of the air for combustion is controlled by the rotational speed of the combustion fan 42. A venturi mixer 44 is provided at the downstream end of the fuel gas passage 41, and controls the flow rate of the fuel gas by the rotational speed of the combustion fan 42. An electromagnetic valve 45 is provided in the fuel gas passage 41, and, by opening and closing the electromagnetic valve 45, the fuel gas supply is started or stopped.

The burner 43 starts combustion by igniting the mixture gas blown by the combustion fan 42 with an ignition device 46 that is provided below the burner 43. A combustion sensor 47 is provided below the burner 43 and detects the state of combustion.

The main heat exchanger 10 is provided below the ignition device 46 and the combustion sensor 47. The main heat exchanger 10 and the burner 43 are housed within a housing 48 that defines a passage for the combustion gases. The combustion gases generated by combustion of the mixture gas in the burner 43 are sent to the main heat exchanger 10, and, after having exchanged heat with the heating thermal medium, are exhausted to the exterior via an exhaust passage 49 that extends from the lower portion of the housing 48. An exhaust temperature sensor 50 is provided at the downstream end portion of the exhaust passage 49, and is capable of detecting the temperature of the exhausted combustion gases.

The main heat exchanger 10 comprises a primary heat exchanger 10*a* that recovers sensible heat from the combustion gases, and a secondary heat exchanger 10*b* that recovers latent heat from the combustion gases. These two heat exchangers 10*a*,10*b* are connected so that the heating thermal medium to which heat has first been applied by the secondary heat exchanger 10*b* then receives further heat from the primary heat exchanger 10*a*. A drainage passage 51 is provided at the bottom portion of the housing 48, and discharges drainage water that has been condensed in the secondary heat exchanger 10*b* to the exterior. In order to prevent the combustion gases from flowing out, a drainage trap 52 is provided at the downstream end portion of the drainage passage 51.

Next, the circulation passage 4 will be explained.

A first temperature sensor 13 capable of detecting the temperature of the heating thermal medium flowing into the main heat exchanger 10 is provided in the circulation passage 4 between the circulation pump 11 and the main heat exchanger 10. And a second temperature sensor 14 capable of detecting the temperature of the heating thermal medium to which heat has been applied by the main heat exchanger 10 is provided on the downstream side of the main heat exchanger 10.

A first distribution valve 15 is provided at the portion where the first bypass passage 12 branches off from the circulation passage 4, at the downstream side of the main heat exchanger 10. The first distribution valve 15 is capable of performing distribution while adjusting the distribution ratio of the heating thermal medium to which heat has been applied by the main heat exchanger 10 between the circulation passage 4 and the first bypass passage 12. The first bypass passage 12 rejoins the circulation passage 4 at the upstream side of the circulation pump 11.

A pressure relief valve 16 that relieves the pressure in the circulation passage 4 is provided between the main heat exchanger 10 and the first distribution valve 15. And a heating return temperature sensor 17 capable of detecting the temperature of the heating thermal medium returning from the heating apparatus is provided at the upstream side of the circulation pump 11. Moreover, a replenishment passage 18 for replenishing the heating thermal medium is connected between the circulation pump 11 and the heating return temperature sensor 17.

Next, the hot water supply passage 21 will be explained. The hot water supply passage 21 is capable of supplying cold water to the heat exchanger for hot water supply 20, and also is capable of supplying hot water to which heat has been applied by the heat exchanger for hot water supply 20 to a hot water supply faucet or the like, and moreover a second bypass passage 22 is provided that branches off from the hot water supply passage 21 and bypasses the heat exchanger for hot water supply 20. A second distribution valve 23, which is equivalent to a flow rate adjustment means, is provided at the branching portion between the hot water supply passage 21 and the second bypass passage 22. The second distribution valve 23 is capable of cold water distribution by adjusting the distribution ratio between the hot water supply passage 21 and the second bypass passage 22. Due to this, the second distribution valve 23 is capable of regulating the flow rate of cold water flowing into the hot water supply passage 21.

A flow rate regulation valve 24, a hot water supply amount sensor 25, and an intake water temperature sensor 26 are provided at the upstream side of the second distribution valve 23. The flow rate regulation valve 24 is capable of regulating the flow rate of the cold water that passes into the second distribution valve 23. The hot water supply amount sensor 25 is capable of detecting the flow rate of the cold water that has been thus regulated. The intake water temperature sensor 26 is capable of detecting the temperature of the intake cold water that passes into the second distribution valve 23.

An output hot water temperature sensor 27 is provided between the location where the hot water supply passage 21 and the second bypass passage 22 join together and the heat exchanger for hot water supply 20. The output hot water temperature sensor 27 is capable of detecting the temperature of the hot water outputted from the heat exchanger for hot water supply 20. And a hot water supply temperature sensor 28 is provided downstream of the location where the hot water supply passage 21 and the second bypass passage 22 join together. The hot water supply temperature sensor 28 is capable of detecting the temperature of the mixture hot water that results from the mixing together of the hot water to which heat has been applied by the heat exchanger for hot water supply 20 and the cold water flowing through the second bypass passage 22.

Next, the heat exchanger for hot water supply 20 will be explained. The heat exchanger for hot water supply 20 provided in the first bypass passage 12 is a plate type heat exchanger. In such a plate type heat exchanger, a plurality of heat exchange plates are laminated together so that passages are defined between the heat exchange plates. Within the heat exchanger for hot water supply 20, the heating thermal medium and the supply water for hot water flow through alternate passages defined between the heat exchange plates, arranged so that these flows oppose one another and do not mix with one another. The surface area of each of the heat exchange plates is formed with irregular roughnesses, in order to enhance the heat exchange efficiency.

Figure 2:
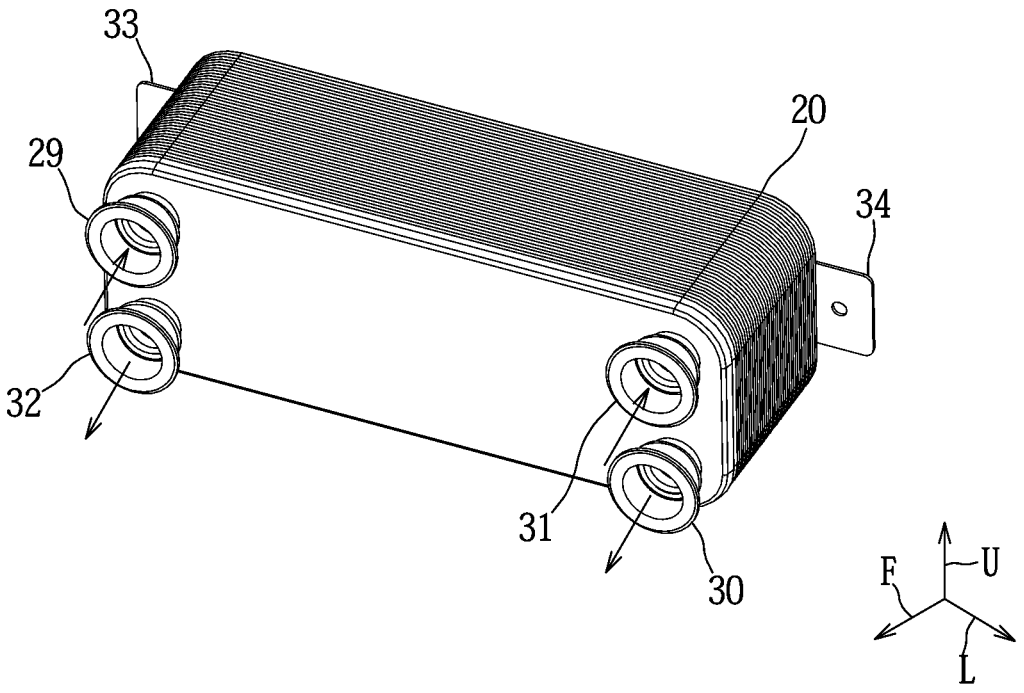
FIG. 2 is a perspective view of a heat exchanger for hot water supply.

As shown in FIG. 2, the heat exchanger for hot water supply 20, on one of its side portions, for example on its front surface portion, comprises a pair of connection portions 29, 30 that are connected to the first bypass passage 12 and that respectively serve as an inlet and an outlet for the heating thermal medium, and a pair of connection portions 31, 32 that are connected to the hot water supply passage 21 and that respectively serve as an inlet and an outlet for the supply water for hot water.

The connection portion 29 which is the inlet for the heating thermal medium and the connection portion 32 which is the outlet for the hot water supply are provided at one end portion of the heat exchanger for hot water supply 20, for example at its right end portion, and the connection portion 30 which is the outlet for the heating thermal medium and the connection portion 31 which is the inlet for the supply water for hot water are provided at the other end portion thereof, for example its left end portion, so that the heating thermal medium and the supply water for hot water flow in opposite directions within the heat exchanger for hot water supply 20. Moreover, a plurality of attachment lugs 33, 34 are provided on the rear surface portion of the heat exchanger for hot water supply 20.

Figure 3:
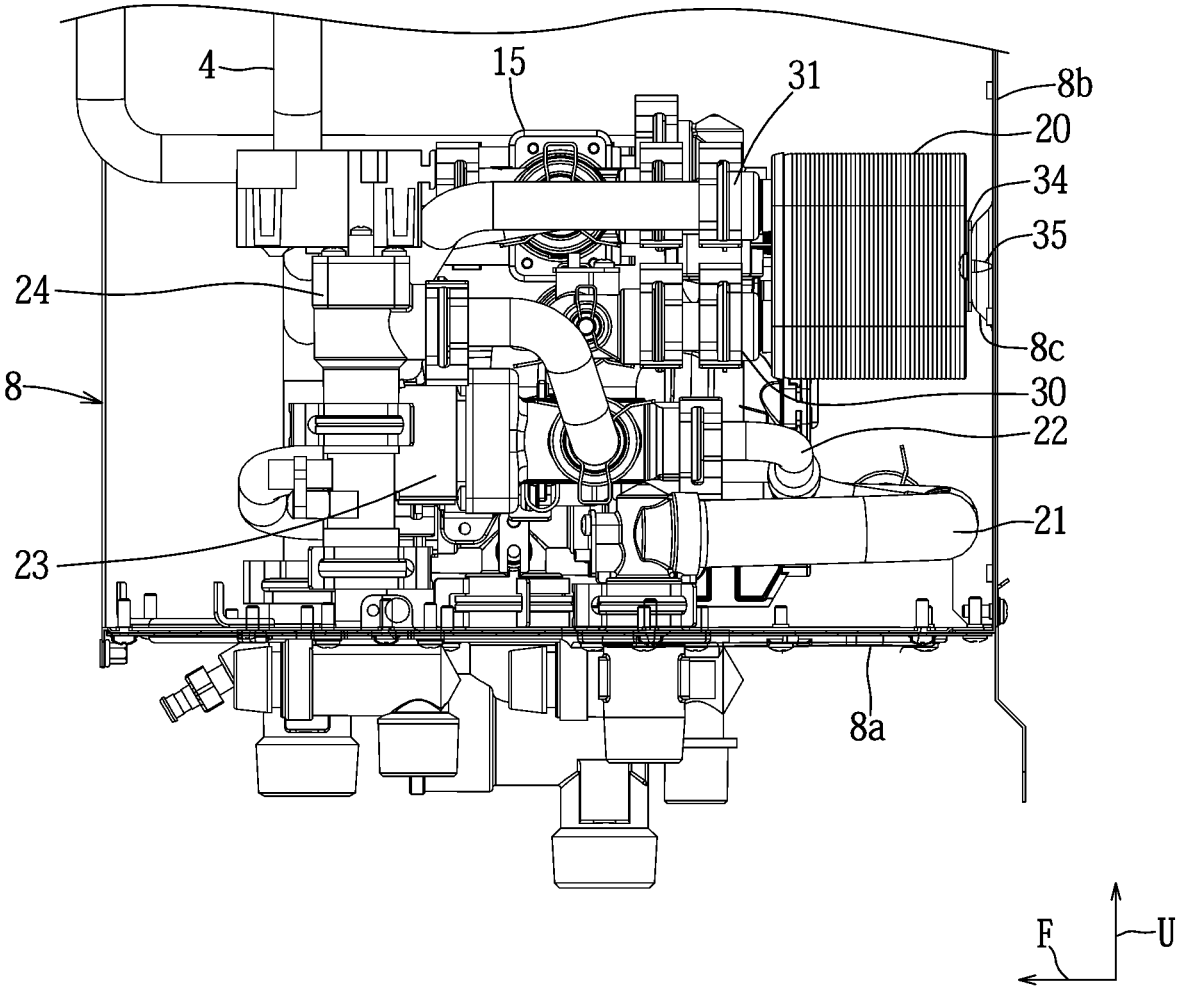
FIG. 3 is a right side view of principal portions of the heating and hot water supply device.

As shown in FIG. 3, the heat exchanger for hot water supply 20 is spaced upward away from the bottom plate 8*a* of the casing 8, and moreover the attachment lug 34 that is provided to the heat exchanger for hot water supply 20 is fixed, for example by a screw 35, to an attachment portion 8*c* that is provided on the rear surface portion 8*b* of the casing 8. The attachment lug 33 is likewise fixed by a screw to an attachment portion, although this construction is not shown in the figure.

Figure 5:
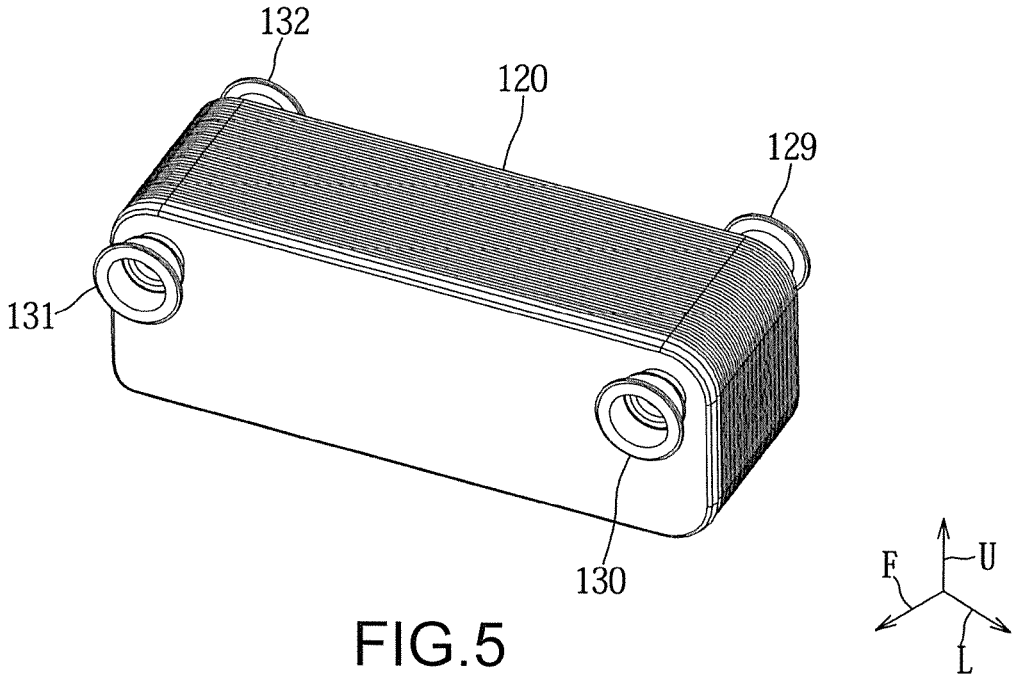
FIG.5 (Related Art)
FIG. 5 is a perspective view of a heat exchanger for hot water supply according to a prior art.

Since the heat exchanger for hot water supply 20 is not supported by any legs underneath the heat exchanger for hot water supply 20, accordingly a space that is capable of accommodating conduits or the like is simply and easily ensured between the heat exchanger for hot water supply 20 and the bottom plate 8*a*. Moreover, along with the required installation space for the heat exchanger for hot water supply 20 becoming more compact in the front to rear direction due to the fact that no connection portions or connection conduits like those that were present on the rear surface portion of a prior art plate type heat exchanger (refer to FIG. 5) are not present on the rear surface portion of the heat exchanger for hot water supply 20, also, since it is possible for the rear surface portion of the heat exchanger for hot water supply 20 to be brought very close to the rear surface portion 8*b* of the casing 8 so as almost to contact against it, accordingly the space in front of the heat exchanger for hot water supply 20 in which it is possible to install conduits or the like is enlarged.

A portion of the hot water supply passage 21 and a portion of the second bypass passage 22 are arranged within the space between the heat exchanger for hot water supply 20 and the bottom plate 8*a*. Along with a portion of the circulation passage 4 and a portion of the hot water supply passage 21 being disposed in the space in front of the heat exchanger for hot water supply 20 which has been enlarged, also the first and second distribution valves 15, 23 and the control unit 7 (not shown in the figures) and so on are disposed therein. By enlarging the space in front of the heat exchanger for hot water supply 20 as described above, along with it becoming possible to dispose the first and second distribution valves 15, 23 therein, also it is possible to ensure sufficient working space, so that the ease of maintenance is enhanced.

Next, the control unit 7 will be explained.

Although this feature is not shown in the figure, the control unit 7 is capable of receiving detection signals from the various temperature sensors and so on provided within the heating and hot water supply device 1, and moreover is connected to the circulation pump 11 and the first distribution valve 15 and so on so as to be capable of controlling them. Moreover, the control unit 7 is connected to an operation device that is provided within the building to which this heating and hot water supply device 1 is provided, so as to be capable of communicating therewith. The operation device may, for example, comprise a display unit that is capable of displaying, for example, temperature and operating status and so on, and an actuation unit for performing setting of the heating temperature and the hot water supply temperature, and for performing starting actuation and stopping actuation for heating operation and so on.

Next, the operation and the advantageous effects of the heating and hot water supply device 1 will be explained.

When space heating operation is started by actuation of the operation device, the control unit 7 adjusts the first distribution valve 15 so that the heating thermal medium circulates only through the circulation passage 4, and, along with operating the circulation pump 11 so that the heating thermal medium is circulated, also operates the combustion fan 42 and the ignition device 46 so as to cause mixture gas to be combusted by the burner 43. The combustion gases that are thereby generated apply heat to the heating thermal medium in the main heat exchanger 10. And, due to the heating operation being continued, the heating thermal medium is heated up to a predetermined temperature and is circulated.

Hot water supply operation starts when, due to a faucet such as a hot water supply faucet or the like being opened, the hot water supply amount sensor 25 detects a flow rate equal to a predetermined flow rate or higher. If heating operation is not being performed, then the control unit 7 adjusts the first distribution valve 15 so that the heating thermal medium circulates only in the first bypass passage 12, and, along with operating the circulation pump 11 to circulate the heating thermal medium, also combusts fuel gas with the burner 43 by operating the ignition device 46. The combustion gases created in this manner apply heat to the heating thermal medium in the main heat exchanger 10, and heat is applied by the heating thermal medium to the supply water for hot water in the heat exchanger for hot water supply 20.

In order to adjust the temperature of hot water supply to the set hot water supply temperature, the control unit 7 adjusts the distribution ratio of the second distribution valve 23 on the basis of the output hot water temperature detected by the output hot water temperature sensor 27 and the hot water supply temperature detected by the hot water supply temperature sensor 28 and so on. Due to this, the hot water to which heat has been applied by the heat exchanger for hot water supply 20 and the cold water flowing in the second bypass passage 22 are mixed together in a ratio adjusted by the second distribution valve 23, and accordingly it is possible to control properly the hot water supply temperature so that it becomes equal to the set hot water supply temperature.

Moreover, if hot water supply operation is started during the heating operation, then the control unit 7 adjusts the first distribution valve 15 so that the heating thermal medium is circulated only through the first bypass passage 12, whereby the heating thermal medium is circulated through the first bypass passage 12, and heat is applied to the supply water for hot water by the heat exchanger for hot water supply 20. And the control unit 7 regulates the supply water for hot water as described above, so that it is supplied at the set hot water supply temperature. Furthermore if, on the basis of the set hot water supply temperature and the output hot water temperature and so on, the control unit 7 determines that simultaneous heating operation and hot water supply operation are possible, then the control unit 7 is able to perform simultaneous space heating operation and hot water supply operation by changing the distribution ratio of the first distribution valve 15.

Second Embodiment

Figure 4:
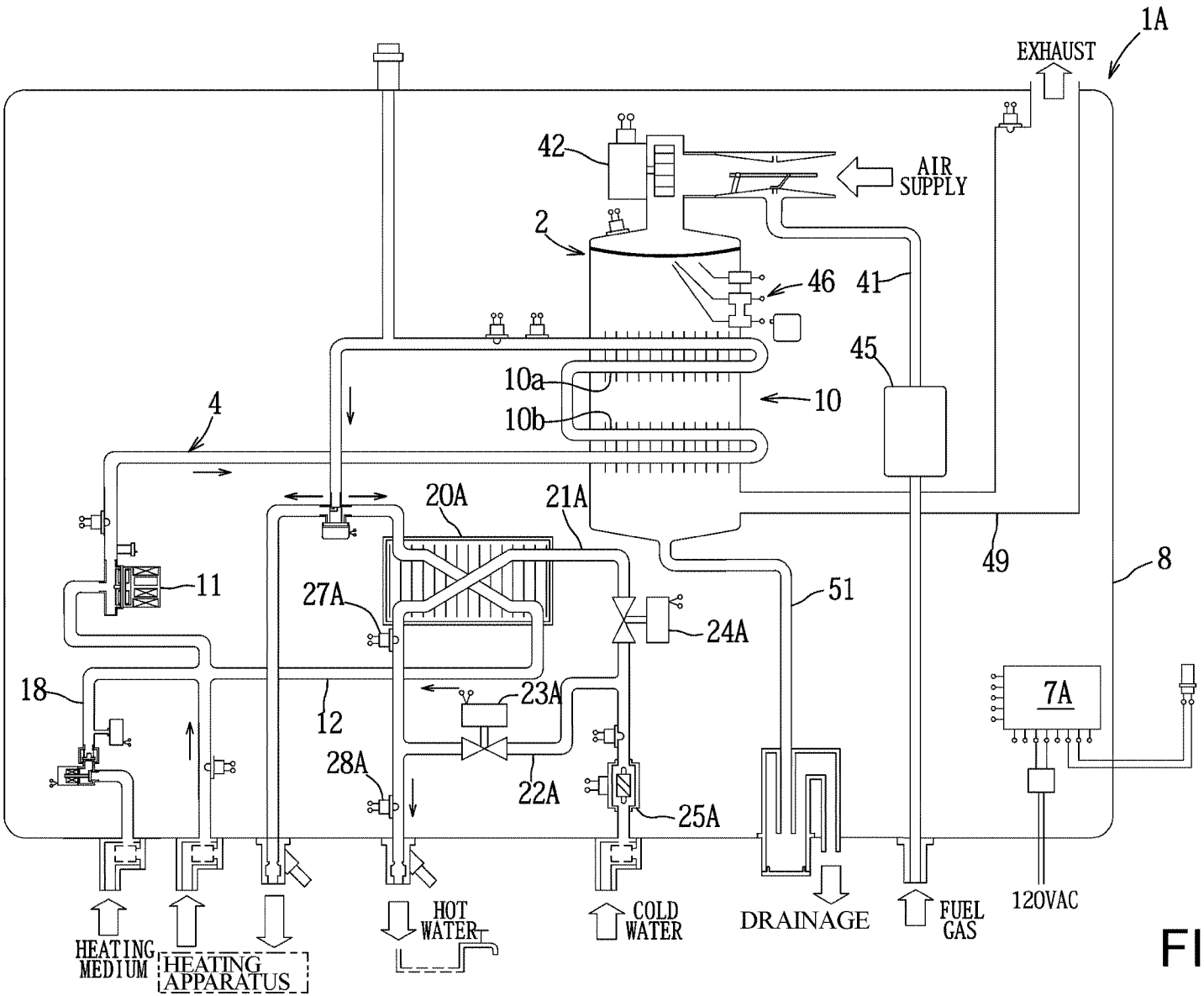
FIG. 4 is a schematic view of a heating and hot water supply device of a second embodiment.

Next, a heating and hot water supply device 1A according to a second embodiment will be explained with reference to FIG. 4. Instead of the second distribution valve 23 which was the flow rate adjustment means for the second bypass passage in the first embodiment, the heating and hot water supply device 1A comprises a bypass flow rate regulation valve 23A that is provided in the second bypass passage 22A, so that it is possible to adjust the flow rate in the second bypass passage 22A. The second bypass passage 22A is branched off from between a flow rate regulation valve 24A that is provided in the hot water supply passage 21A and a hot water supply amount sensor 25A.

Next, the operation and the advantageous effects of the heating and hot water supply device 1A will be explained.

In hot water supply operation, in order to regulate the supply water for hot water to the set hot water supply temperature, the control unit 7A adjusts the flow rate ratio between the bypass flow rate regulation valve 23A and the flow rate regulation valve 24A on the basis of the output hot water temperature detected by the output hot water temperature sensor 27A, the hot water supply temperature detected by the hot water supply temperature sensor 28A, and so on. By doing this, it is possible to perform control so that the hot water supply temperature becomes the set hot water supply temperature in an appropriate manner by mixing together the hot water to which heat has been applied by the heat exchanger for hot water supply 20A and the fresh water that is flowing in the second bypass passage 22A.

Next, examples in which the embodiments described above are partially altered will be explained.

[1] The heat exchanger for hot water supply 20 could also be attached, not to the rear portion of the casing 8, but to its side portion.

[2] A structure would also be acceptable in which the burner 43 is constructed to be of the upward directed combustion type that is capable of retrieving heat from combustion gases that flow upward.

[3] Apart from the above, for a person skilled in the art, it would be possible to implement the present invention by adding various changes to the embodiments described above without deviating from the gist of the invention, and the present invention is to be understood as including such variant embodiments.

DESCRIPTION OF REFERENCE NUMERALS

1: heating and hot water supply device
2: combustion unit (combustion means)
4: circulation passage
7: control unit
8: casing
8*a*: bottom plate
10: main heat exchanger
11: circulation pump
12: first bypass passage
15: first distribution valve (distribution means)
20: heat exchanger for hot water supply
21: hot water supply passage
22: second bypass passage
23: second distribution valve (flow rate adjustment means)
23A: bypass flow rate regulation valve
24: flow rate regulation valve
25: hot water supply amount sensor
29, 30: connection portions
31, 32: connection portions

The invention claimed is:

1. A heating and hot water supply device, comprising a combustion means, a main heat exchanger, a circulation passage connected to said main heat exchanger and a heating apparatus, a circulation pump provided in the circulation passage, a first bypass passage that branches off from the circulation passage and bypasses the heating apparatus, a heat exchanger for hot water supply provided in the first bypass passage, and a hot water supply passage for supplying cold water to the heat exchanger for hot water supply, and for supplying hot water heated by the heat exchanger for hot water supply, wherein:

a distribution means is provided at a branching portion of the first bypass passage, and the distribution means is capable of adjusting a distribution ratio so that heating operation, or hot water supply operation, or simultaneous heating operation and hot water supply operation become possible;

a second bypass passage that bypasses the heat exchanger for hot water supply is provided in the hot water supply passage, wherein a flow rate adjustment means is provided at a branching portion of the second bypass passage, and the flow rate adjustment means is capable of adjusting a distribution ratio between the heat exchanger for hot water supply and the second bypass passage and distributing cold water; and an output hot water temperature sensor is provided between a location where the hot water supply passage and the second bypass passage join together and the heat exchanger for hot water supply, the output hot water temperature sensor detects a temperature of the hot water outputted from the heat exchanger for hot water supply, a hot water supply temperature sensor is provided downstream of a location where the hot water supply passage and the second bypass passage join together, the hot water supply temperature sensor detects a temperature of a mixture hot water that results from mixing together of the hot water to which heat has been applied by the heat exchanger for hot water supply and the cold water flowing through the second bypass passage, the flowrate adjustment means adjusts a distribution ratio of cold water distribution based on the temperatures detected by the output hot water temperature sensor and the hot water supply temperature sensor, and the heat exchanger for hot water supply is constituted with a plate type heat exchanger, with a pair of connection portions of the first bypass passage and a pair of connection portions of the hot water supply passage being disposed on one side portion thereof.

2. The heating and hot water supply device according to claim 1, wherein the heat exchanger for hot water supply is connected so that the heating thermal medium and the supply water for hot water for hot water flow in opposite directions.

3. The heating and hot water supply device according to claim 2, wherein the heat exchanger for hot water supply is disposed above a bottom plate of a casing of the heating and hot water supply device so as to be separated therefrom, with a portion of the second bypass passage being disposed between the heat exchanger for hot water supply and the bottom plate.

4. The heating and hot water supply device according to claim 1, wherein the heat exchanger for hot water supply is disposed above a bottom plate of a casing of the heating and hot water supply device so as to be separated therefrom, with a portion of the second bypass passage being disposed between the heat exchanger for hot water supply and the bottom plate.

* * * * *